US009059513B2

(12) United States Patent
Huang et al.

(10) Patent No.: US 9,059,513 B2
(45) Date of Patent: Jun. 16, 2015

(54) MULTIBAND ANTENNA STRUCTURE

(75) Inventors: Yu-Tsung Huang, Kaohsiung (TW); Jian-Min Tsai, New Taipei (TW); Ching-Wei Chang, New Taipei (TW)

(73) Assignee: AUDEN TECHNO CORP., Taoyuan County (TW)

( * ) Notice: Subject to any disclaimer, the term of this patent is extended or adjusted under 35 U.S.C. 154(b) by 134 days.

(21) Appl. No.: 13/618,201

(22) Filed: Sep. 14, 2012

(65) Prior Publication Data

US 2014/0078000 A1 Mar. 20, 2014

(51) Int. Cl.

| | |
|---|---|
| ***H01Q 1/38*** | (2006.01) |
| ***H01Q 5/40*** | (2015.01) |
| *H01Q 1/24* | (2006.01) |
| *H01Q 9/42* | (2006.01) |

(52) U.S. Cl.

CPC ..... *H01Q 5/40* (2015.01); *H01Q 1/243* (2013.01); *H01Q 1/38* (2013.01); *H01Q 9/42* (2013.01)

(58) Field of Classification Search

CPC ..... H01Q 1/243; H01Q 1/38; H01Q 5/40
USPC ..... 343/702, 700 MS
See application file for complete search history.

(56) References Cited

U.S. PATENT DOCUMENTS

| | | | | |
|---|---|---|---|---|
| 6,683,571 | B2 * | 1/2004 | Ghosh et al. | 343/700 MS |
| 7,119,748 | B2 * | 10/2006 | Autti | 343/702 |
| 7,616,158 | B2 * | 11/2009 | Mak et al. | 343/700 MS |
| 7,791,546 | B2 * | 9/2010 | Hotta et al. | 343/702 |
| 8,004,470 | B2 * | 8/2011 | Sorvala et al. | 343/700 MS |
| 8,754,817 | B1 * | 6/2014 | Kuo et al. | 343/702 |
| 2003/0043081 | A1 * | 3/2003 | Achim | 343/702 |
| 2008/0079642 | A1 * | 4/2008 | Ishizuka et al. | 343/702 |

* cited by examiner

*Primary Examiner* — Dameon E Levi
*Assistant Examiner* — Hasan Islam
(74) *Attorney, Agent, or Firm* — Li & Cai Intellectual Property (USA) Office

(57) ABSTRACT

A multiband antenna structure comprises a substrate, a first radiating unit and a second radiating unit. The first radiating unit is disposed on the substrate, having a feed-in end, a first radiating path and a first terminal. The first radiating unit is operated at a first operating frequency. The second radiating unit is disposed on the substrate and has a grounding end, a second radiating path and a second terminal. The second radiating unit is operated at a second operating frequency. The first terminal of the first radiating unit is adjacent to the second radiating path or the second terminal of the second radiating unit is adjacent to the first radiating path for the first radiating unit or the second unit to excite a third operating frequency. The third operating frequency is lower than the lower frequency among the first operating frequency and the second operating frequency.

8 Claims, 5 Drawing Sheets

MULTIBAND ANTENNA STRUCTURE

BACKGROUND

1. Technical Field

The present disclosure relates to antenna, in particular, to the multiband antenna structure.

2. Description of Related Art

For current wireless communication system, antenna is an essential element. According to the communication regulation of the mobile phone system, phones with different standards need different operating frequency bands for their antennas. For example, the common Global System for Mobile communications (GSM) of the second generation (2G) mobile phone needs to use the frequency band near 900 MHz and 1800 MHz, and the Universal Mobile Telecommunications System (UMTS) of the third generation (3G) mobile phone needs to use the frequency band near 1900 MHz to 2100 MHz.

With the development of mobile phone system, users not only need the voice communication but also gradually need the high speed data transmission. Therefore, recently, telecommunication corporations provide the Long Term Evolution system (LTE) as a solution. The long term evolution is a new regulation so the antenna producers and designers also need to provide a corresponding solution especially for the Long Term Evolution system (LTE). The used frequency band of the Long Term Evolution system (LTE) differs from country to country. For instance, 700/1800 MHz and 1700/1900 MHz in the North America, 800/1800/2600 MHz in the Europe, and 1800/2600 MHz . . . etc in the Asia.

SUMMARY

According to one exemplary embodiment of the present disclosure, a multiband antenna structure is provided to generate a plurality operating frequencies to apply in the wireless communication device operated in the multiband and to have lower operating frequencies of the practical antenna design.

An exemplary embodiment of the present disclosure provides a multiband antenna structure, including a substrate, a first radiating unit and a second radiating unit. The first radiating unit, disposed on the substrate, has a feed-in end, a first radiating path and a first terminal, and is operated at a first operating frequency. The second radiating unit, disposed on the substrate, has a grounding end, a second radiating path and a second terminal, and is operated at a second operating frequency. The first terminal of the first radiating unit is adjacent to the second radiating path or the second terminal of the second radiating unit is adjacent to the first radiating path, so that the first radiating unit or the second unit excites a third operating frequency, wherein the third operating frequency is lower than the lower frequency among the first operating frequency and the second operating frequency.

To sum up, the multiband antenna structure provided by the exemplary embodiments of the present disclosure produces a plurality of operating frequencies and excites a lower operating frequency (the third operating frequency) than frequencies the first radiating unit and the second radiating unit excites independently (the first operating frequency and the second frequency).

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are comprised to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1A:
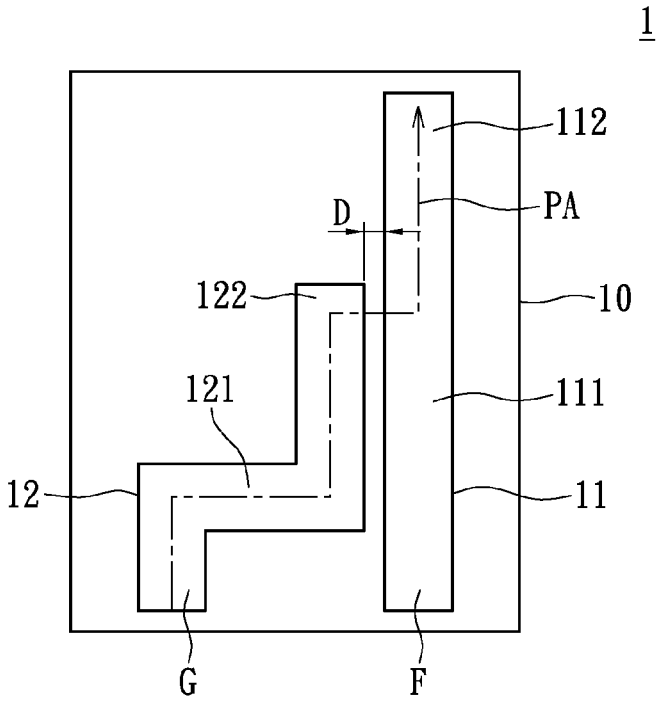
FIG. 1A is a schematic diagram of the multiband antenna structure of an embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

The multiband antenna structure of the present disclosure has two radiating units and the connection design of the two radiating units is realized on a substrate. The following FIG. 1A and FIG. 1B help to explain for more easily understanding the present disclosure. However, the present disclosure is not limited thereto, and other embodiments would be also explained as follow.

Please refer to FIG. 1A. FIG. 1A is a schematic diagram of the multiband antenna structure of an embodiment of the present disclosure. A multiband antenna structure 1 comprises a substrate 10, a first radiating unit 11 and a second radiating unit 12. The first radiating unit 11 has a feed-in end F, a first radiating path 111 and a first terminal 112. The radiating unit 12 has a grounding end G, a second radiating path 121 and a second terminal 122.

The first radiating unit 11 is disposed on the substrate 10 and operated at a first operating frequency. The second radiating unit 12 is disposed on the substrate 10 and operated at a second frequency. The first terminal 112 of the first radiating unit 11 is adjacent to the second radiating path 121 or the second terminal 122 of the second radiating unit 12 is adjacent to the first radiating path 111 for the first radiating unit 11 or the second unit 12 to excite a third operating frequency $f_L$, wherein the third operating frequency $f_L$ is lower than the lower frequency among the first operating frequency and the second frequency.

The substrate 10 is made of commonly used glass fiber (ex: FR4.) or the ceramic material, and the present disclosure is not limited thereto. The first radiating unit 11 is a monopole antenna and the second radiating unit is a coupling monopole antenna by coupling the energy of the first radiating unit 11. Thus, the first operating frequency of the first radiating unit 11 is the corresponding operating frequency when the electrical length of the first radiating unit 11 is a quarter of the wave-length, and the second operating frequency of the second radiating unit 12 is the corresponding operating frequency when the electrical length of the second radiating unit 12 is a quarter of the wave-length. The first radiating unit 11 and the second radiating unit 12 are disposed on the same substrate, so the first operating frequency and the second operating frequency are determined by the length of the first radiating unit 11 and the second radiating unit 12, wherein the lower frequency among the first operating frequency and the second operating frequency is corresponded to the longer radiating unit.

As shown in FIG. 1A, the second terminal 122 of the second radiating unit 12 is adjacent to the first radiating path 111. For example, the second terminal 122 is adjacent to the first radiating path 111 and has a predetermined distance D having the second terminal 122 couple to the energy of the first radiating path 111 or having the energy of the second terminal 122 couple to the first radiating path 111. The predetermined distance D between the second terminal 122 and the first radiating path 111 is, for example, between 0.5 mm to 5 mm, but the present disclosure is not limited thereto.

Please refer to FIG. 1A again, the excitation of the third frequency $f_L$ is resulted from the coupling path PA. The coupling path PA, starting from the grounding end G, is extended to the second radiating path 121 and the second terminal 122, by coupling, further extended to the first radiating path 111 adjacent to the second terminal 122, and then extended to the first terminal 112 along the first radiating path 111. The length of the coupling path PA is longer than the length of the first radiating unit 21 and the length of the second radiating unit 22, so the third frequency $f_L$ is lower than the lower frequency among the first operating frequency and the second operating frequency.

Figure 1B:
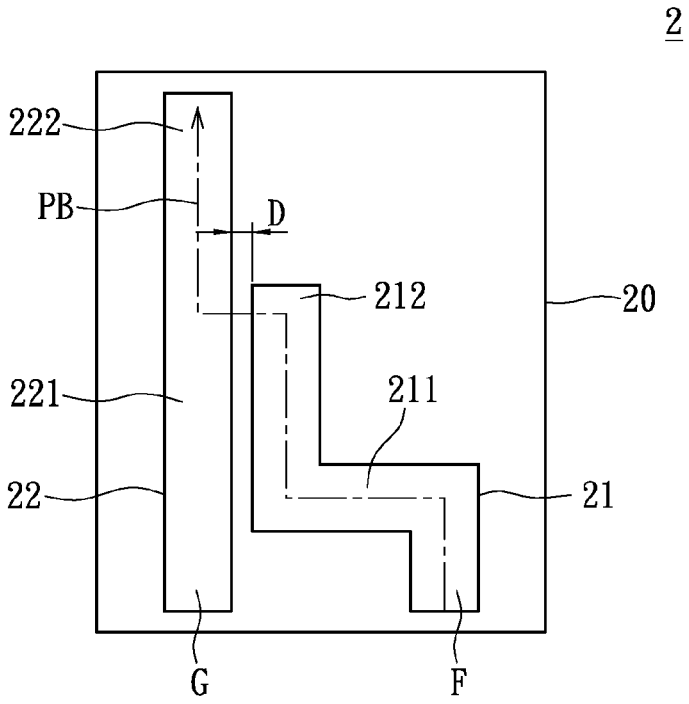
FIG. 1B is a schematic diagram of the multiband antenna structure of an embodiment of the present disclosure.

Please refer to FIG. 1B. FIG. 1B is a schematic diagram of the multiband antenna structure of an embodiment of the present disclosure. A multiband antenna structure 2 comprises a substrate 20, a first radiating unit 21 and a second radiating unit 22. The first radiating unit 21 has a feed-in end F, a first radiating path 211 and a first terminal 212. The radiating unit 22 has a grounding end G, a second radiating path 221 and a second terminal 222.

The first radiating unit 21 is disposed on the substrate 20 and operated at a first operating frequency. The second radiating unit 22 is disposed on the substrate 20 and operated at a second frequency. The first terminal 211 of the first radiating unit 21 is adjacent to the second radiating path 221. For example, the first terminal 211 is adjacent to the second radiating path 221 and has a predetermined distance D having the first terminal 211 couple to the energy of the second radiating path 221 or having the energy of the first terminal 211 couple to the second radiating path 221. The predetermined distance D between the first terminal 211 and the second radiating path 221 are, for example, between 0.5 mm to 5 mm, but the present disclosure is not limited thereto.

Please refer to FIG. 1B again, the excitation of the third frequency $f_L$ is be resulted from the coupling path PB. The coupling path PB, starting from the feed-in end F, is extended to the first radiating path 211 and the first terminal 212, by coupling, further extended to the second radiating path 221 adjacent to the first terminal 212, and then extended to the second terminal 222 along the second radiating path 221. The length of the coupling path PB is longer than the length of the first radiating unit 21 and the length of the second radiating unit 22, so the third frequency $f_L$ is lower than the lower frequency among the first operating frequency and the second operating frequency.

According to FIG. 1A, FIG. 1B and the above explanation, the excitation of the third frequency $f_L$ is resulted from the situation that the first terminal 112 of the first radiating unit 11 is adjacent to the second radiating path 121 or the second terminal 122 of the second radiating unit 12 is adjacent to the first radiating path 111, so that the first radiating unit 11 or the second radiating unit 12 excites the third operating frequency $f_L$.

Figure 2A:
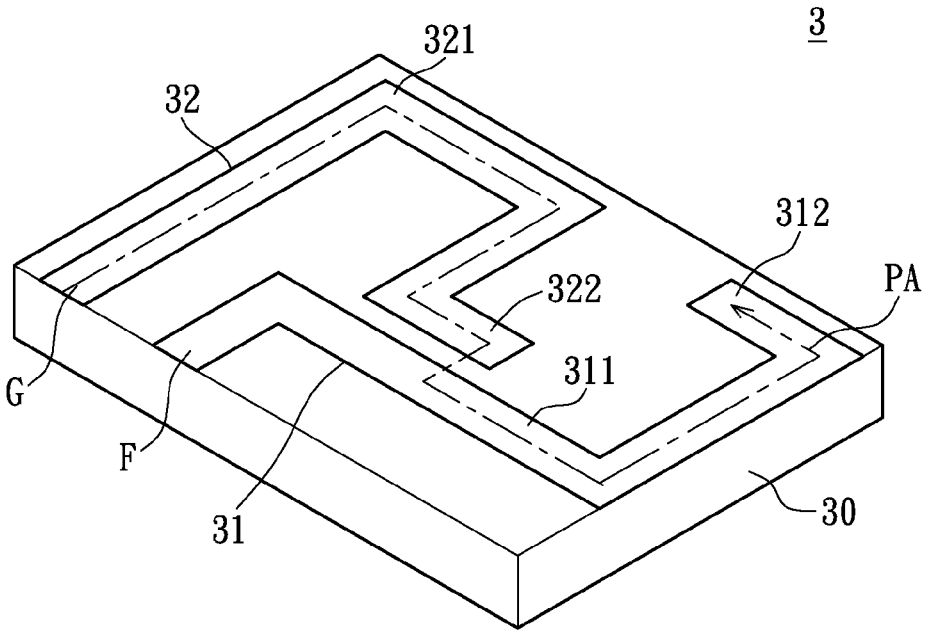
FIG. 2A is a schematic diagram of the multiband antenna structure of another embodiment of the present disclosure.

Please refer to FIG. 1A in conjunction with FIG. 2A. FIG. 2A is a schematic diagram of the multiband antenna structure of another embodiment of the present disclosure. In this embodiment, the multiband antenna structure is realized on the upper surface of the substrate (the thickness of the substrate is, for example, not longer than 8 mm, but the present disclosure is not limited thereto) and the first radiating unit and the second radiating unit both have one bending portion at least. A multiband antenna structure 3 is roughly the same as the multiband antenna structure 1 shown in FIG. 1A, but merely different from the fact that the first radiating unit 31 and the second radiating unit 32 of the multiband antenna structure 3 have a plurality of bending portions. A multiband antenna structure 3 comprises a substrate 30, a first radiating unit 31 and a second radiating unit 32. The first radiating unit 31 has a feed-in end F, a first radiating path 311 and a first terminal 312. The radiating unit 32 has a grounding end G, a second radiating path 321 and a second terminal 322. As shown in FIG. 2A, for coupling energy, the second terminal 322 is adjacent to the first radiating path 311. The length of the coupling path PA is longer than the length of the first radiating unit 31 so that there's a third operating frequency $f_L$ lower than the first operating frequency of the first radiating unit 31. Besides, as shown in FIG. 2A, the first radiating path 311 of the first radiating unit 31 has a plurality of bending portions and so does the second radiating path 321 of the second radiating unit 32.

Figure 2B:
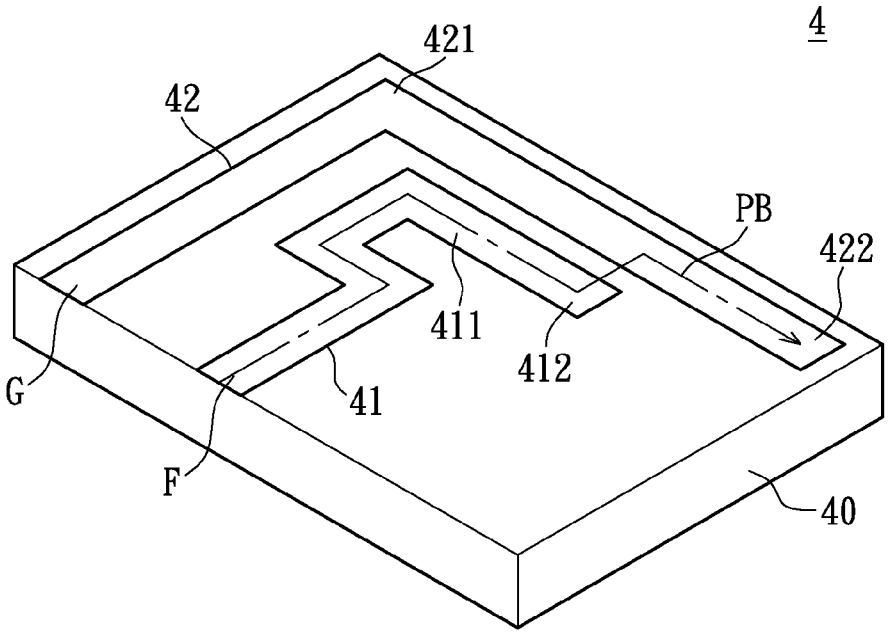
FIG. 2B is a schematic diagram of the multiband antenna structure of another embodiment of the present disclosure.

Please refer to FIG. 1B in conjunction with FIG. 2B. FIG. 2B is a schematic diagram of the multiband antenna structure of another embodiment of the present disclosure. A multiband antenna structure 4 is roughly the same as the multiband antenna structure 2 shown in FIG. 1B, but merely different from the fact that the first radiating unit 41 and the second radiating unit 42 of the multiband antenna structure 4 have a plurality of bending portions. A multiband antenna structure 4 comprises a substrate 40, a first radiating unit 41 and a second radiating unit 42. The first radiating unit 41 has a feed-in end F, a first radiating path 411 and a first terminal 412. The radiating unit 42 has a grounding end G, a second radiating path 421 and a second terminal 422. As shown in FIG. 2B, for coupling energy, the first terminal 412 is adjacent to the second radiating path 421. The length of the coupling path PB is longer than the length of the second radiating unit 42 so that there's a third operating frequency $f_L$ lower than the second operating frequency of the second radiating unit 42.

Figure 3A:
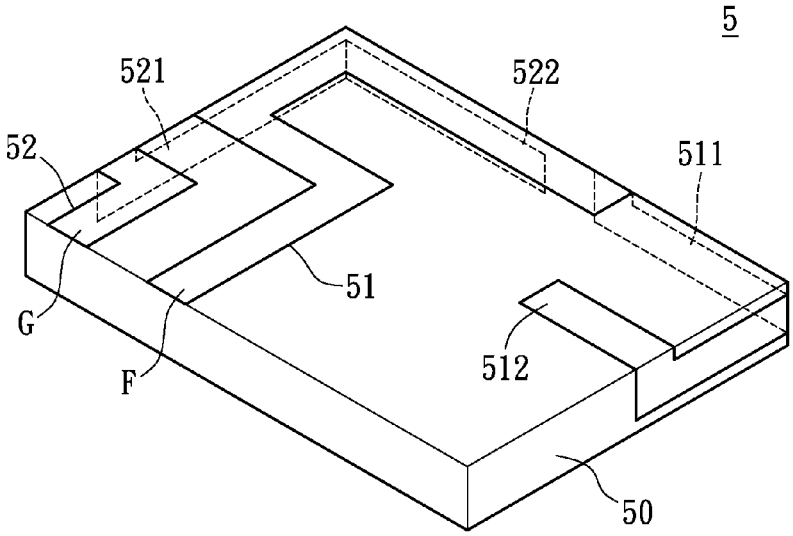
FIG. 3A is a schematic diagram of the multiband antenna structure of another embodiment of the present disclosure.

Please refer to FIG. 2A in conjunction with FIG. 3A. FIG. 3A is a schematic diagram of the multiband antenna structure of another embodiment of the present disclosure. A multiband antenna structure 5 shown in FIG. 3 is roughly the same as the multiband antenna structure 3 shown in FIG. 2A, but merely different from the fact that the substrate of the multiband antenna structure 5 has a plurality of surfaces, and the first radiating unit 51 and the second radiating unit 52 are disposed on the surfaces of the substrate 50. A multiband antenna structure 5 comprises a substrate 50, a first radiating unit 51 and a second radiating unit 52. The first radiating unit 51 has a feed-in end F, a first radiating path 511 and a first terminal 512. The second radiating unit 52 has a grounding end G, a second radiating path 521 and a second terminal 522. The substrate 50 is made of commonly used glass fiber (e.g. FR4.) or the ceramic material, and the present disclosure is not limited thereto.

As shown in FIG. 3A, for coupling energy, the second terminal 522 is adjacent to the first radiating path 511. The coupling path resulted in the excitation of the third frequency $f_L$, starting from the grounding end G, is extended to the second radiating path 521 and the second terminal 522, by coupling, further extended to the first radiating path 511, and then extended to the first terminal 512 along the first radiating path 511. Thus, the length of the coupling path is longer than the length of the first radiating unit 51 and there's a third frequency $f_L$ lower than the first operating frequency of the first radiating unit 51.

Figure 3B:
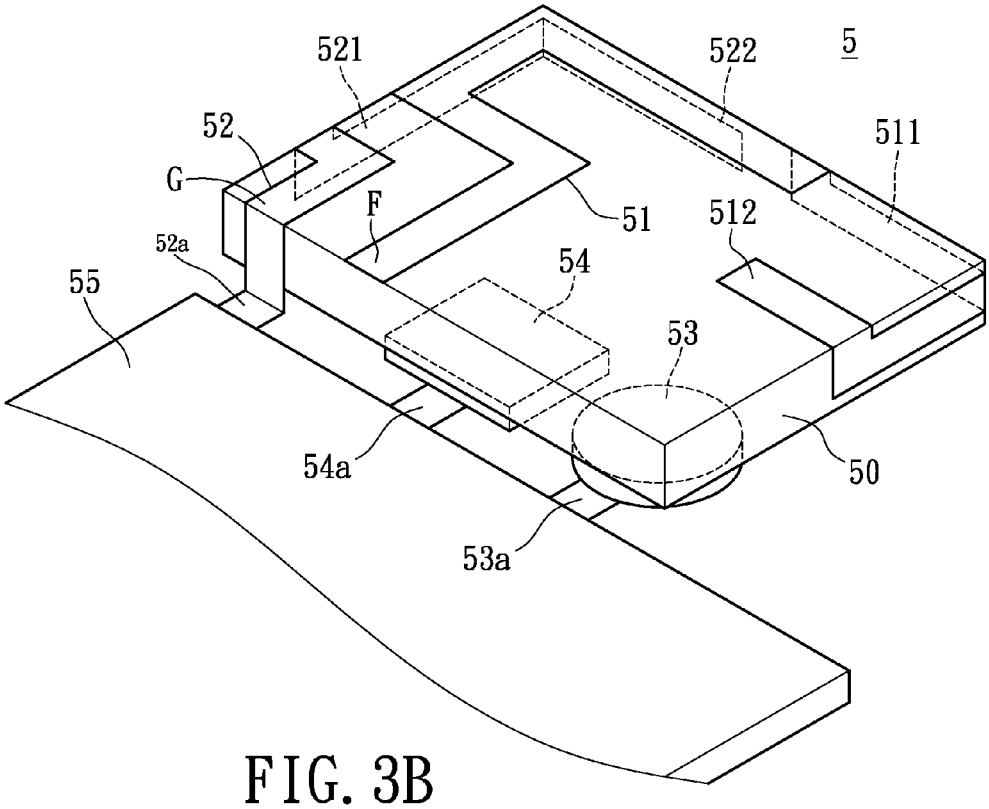
FIG. 3B is a schematic diagram of the multiband antenna structure of another embodiment of the present disclosure.

Please refer to FIG. 3A in conjunction with FIG. 3B. FIG. 3B is a schematic diagram of the multiband antenna structure of another embodiment of the present disclosure. In addition to the elements shown in FIG. 3A, the multiband antenna structure 5 further comprises a grounding surface 55 and conducting elements 53, 54. The conducting elements 53, 54 are disposed under the substrate 50 and the grounding surface 55 is disposed on a side of the conducting elements 53, 54. In other words, the substrate 50 is disposed on a side of the grounding surface 55. The grounding end G of the second radiating unit 52 is connected to the grounding surface 55 through a grounding line 52*a*. The conducting elements 53, 54 are also connected to the grounding surface 55 through grounding lines 53*a*, 54*a*, respectively. The grounding surface 55 is a system grounding surface of a mobile device. Moreover, the feed-in end F of the first radiating unit 51 is for connecting a radio frequency circuit (not shown in figures).

There's a good impedance matching at the third frequency $f_L$ by adjusting the extension and disposition of the first radiating path 511 and the second radiating path 521 and adjusting the disposition of the first terminal 512 and the second terminal 522. Therefore, the conducting elements 53, 54 wouldn't easily affect the operation of the multiband antenna structure 5. Likewise, the negative effects caused by the conducting elements 53, 54 (for example, the bad impedance matching or decreasing radiating efficiency) when operating at the first operating frequency, the second frequency, or even frequencies higher than the third frequency $f_L$, would decrease.

Figure 4:
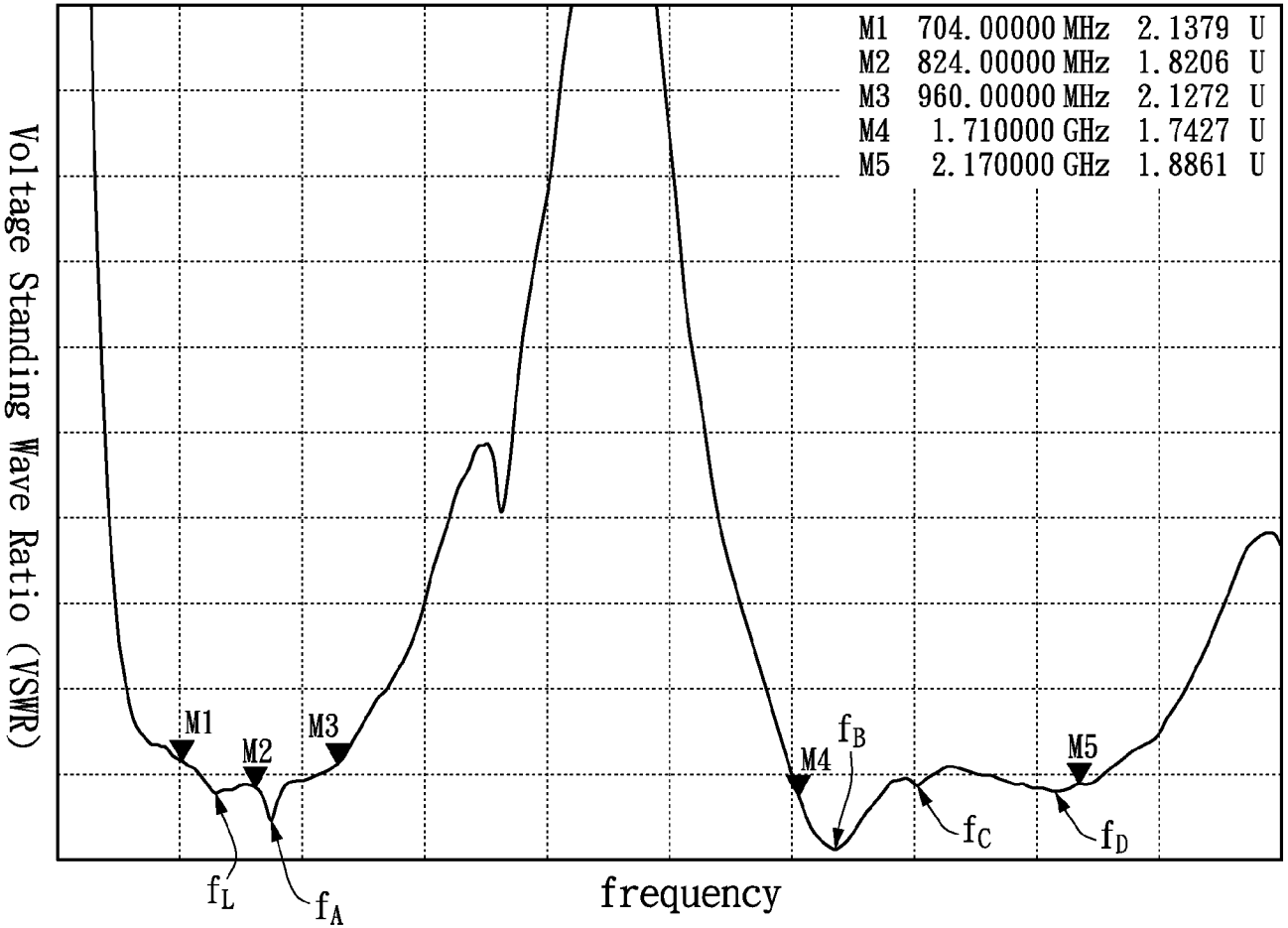
FIG. 4 is a waveform diagram describing the frequency change with voltage standing wave ratio (VSWR) of the multiband antenna structure of another embodiment of the present disclosure.

Please refer to FIG. 4. FIG. 4 is a waveform diagram describing the frequency change with voltage standing wave ratio (VSWR) of the multiband antenna structure of another embodiment of the present disclosure. The first operating frequency is $f_A$ (as shown in FIG. 4, the frequency $f_A$ is between the frequency point M2:824 MHz and the frequency point M3:960 MHz) and the frequency $f_A$ is generated by the first radiating unit 51. The second operating frequency is $f_B$ (as shown in FIG. 4, the frequency $f_B$ is between the frequency point M4:1.71 GHz and the frequency point M5:2.17 GHz) and the frequency $f_B$ is generated by the second radiating unit 52. The third frequency $f_L$ is lower than the first operating frequency ($f_A$), as shown in FIG. 4, the third frequency $f_L$ is between the frequency point M1:704 MHz and the frequency point M2:824 MHz. The $f_C$ and $f_D$ are high-frequency operating modes of the first radiating unit 51 and the second radiating unit 52. The central frequency of the high-frequency operating modes is adjusted by changing the bending portion disposition and the number of bending portion of the first radiating unit 51 and the second radiating unit 52. According to FIG. 4, the third frequency $f_L$ is within the low-frequency band (700 MHz to 800 MHz) of the Long Term Evolution system (LTE), so the multiband antenna structure 5 of the present disclosure is applied to the Long Term Evolution system (LTE). For the high frequencies, the high-frequency operating modes of the first radiating unit 51 and the second radiating unit 52 also comprises the high-frequency band (1700 MHz to 2600 MHz) of the Long Term Evolution system (LTE).

Figure 5:
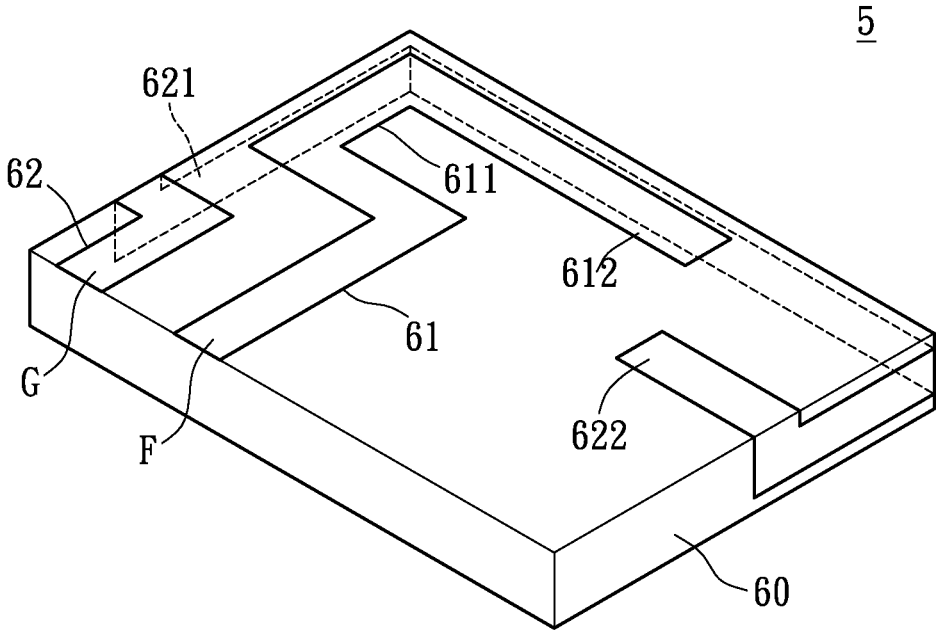
FIG. 5 is a schematic diagram of the multiband antenna structure of another embodiment of the present disclosure.

Please refer to FIG. 2B in conjunction with FIG. 5. FIG. 5 is a schematic diagram of the multiband antenna structure of another embodiment of the present disclosure. A multiband antenna structure 6 shown in FIG. 5 is roughly the same as the multiband antenna structure 4 shown in FIG. 2B, but merely different from the fact that the first radiating unit 61 and the second radiating unit 62 are disposed along a plurality of surfaces of the substrate 60. A multiband antenna structure 6 comprises a substrate 60, a first radiating unit 61 and a second radiating unit 62. The first radiating unit 61 has a feed-in end F, a first radiating path 611 and a first terminal 612. The second radiating unit 62 has a grounding end G, a second radiating path 621 and a second terminal 622.

As shown in FIG. 5. For coupling energy, the first terminal 612 is adjacent to the second radiating path 621. The coupling path resulted in the excitation of the third frequency $f_L$, starting from the feed-in end F, is extended to the first radiating path 611 and the first terminal 612, by coupling, further extended to the second radiating path 621, and then extended to the second terminal 622 along the second radiating path 621. Thus, the length of the coupling path is longer than the length of the second radiating unit 62 and there is a third frequency $f_L$ lower than the second operating frequency of the second radiating unit 62. Other parts of the multiband antenna structure 6 are referred to the above embodiments so the further description is omitted herein.

In summary, according to the embodiments of the present disclosure, the above multiband antenna structures generates a plurality of operating frequencies, and excites a lower operating frequency (the third operating frequency) than frequencies the first radiating unit and the second radiating unit excite independently (the first operating frequency and the second frequency). In other words, the shorter radiating unit excites a much lower third operating frequency by coupling with another radiating unit. The connection design of the first radiating unit and the second radiating unit is realized on the substrate with at least one bending portion in order to decrease the space the antenna would occupy. The multiband antenna has a good impedance matching and enough bandwidth so that the conducting elements near the substrate (for example, under the substrate) wouldn't easily affect the operation of the multiband antenna structure, so as to have the low-frequency bandwidth the Long Term Evolution system (LTE) needs satisfied.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A multiband antenna structure, comprising:

a substrate having an upper surface, a bottom surface opposite to the upper surface, and a side surface;

a first radiating unit, operating at a first operating frequency, disposed on the substrate, having a feed-in end, a first radiating path and a first terminal portion disposed on the upper surface and the side surface of the substrate;

a second radiating unit, operating at a second frequency, disposed on the substrate, having a grounding end, a second radiating path and a second terminal portion disposed on the upper surface and the side surface of the substrate;

a conducting element, disposed on the bottom surface opposite to the upper surface of the substrate; and a grounding surface, disposed adjacent to the substrate and of the conducting element, and electrically connected to the grounding end of the second radiating unit and the conducting element, wherein the grounding surface is electrically separated from the first radiating unit;

wherein the first terminal portion of the first radiating unit is perpendicular to the second radiating path of the second radiating unit, or the second terminal portion of the second radiating unit is parallel to the first radiating path of the first radiating unit, and a distance between the first terminal portion and the second radiating path or between the second terminal portion and the first radiating path is predetermined so that the first radiating unit and the second radiating unit can radiating unit can excite a third operating frequency, wherein the third operating frequency is lower than the lower frequency among the first operating frequency and the second operating frequency.

2. The multiband antenna structure according to claim 1, wherein the first radiating path of the first radiating unit has at least one bending portion.

3. The multiband antenna structure according to claim 1, wherein the second radiating path of the second radiating unit has at least one bending portion.

4. The multiband antenna structure according to claim 1, wherein the substrate has a plurality of surfaces and the first radiating unit is disposed on the plurality of surfaces.

5. The multiband antenna structure according to claim 1, wherein the substrate has a plurality of surfaces and the second radiating unit is disposed on the plurality of surfaces.

6. The multiband antenna structure according to claim 1, further comprising a grounding surface and the substrate is disposed on a side of the grounding surface.

7. The multiband antenna structure according to claim 1, wherein the feed-in end of the first radiating unit connects to a radio frequency circuit.

8. The multiband antenna structure according to claim 1, wherein the substrate is made of glass fiber or ceramic material.

* * * * *